United States Patent [19]

Koziol et al.

[11] Patent Number: 4,619,752

[45] Date of Patent: Oct. 28, 1986

[54] ELECTRODE FOR ELECTROLYTIC EXTRACTION OF METALS OR METAL OXIDES

[75] Inventors: Konrad Koziol, Röthenbach a.d. Pegnitz; Erich Wenk, Nuremberg, both of Fed. Rep. of Germany

[73] Assignee: Conradty GmbH & Co. Metallelektroden KG, Röthenbach a.d. Pegnitz, Fed. Rep. of Germany

[21] Appl. No.: 703,548

[22] Filed: Feb. 20, 1985

[30] Foreign Application Priority Data

Feb. 24, 1984 [DE] Fed. Rep. of Germany ..... 3406777

[51] Int. Cl.[4] ..... C25C 7/02; H01R 43/00

[52] U.S. Cl. ..... 204/286; 204/289; 29/825

[58] Field of Search ..... 204/279, 286, 288, 289, 204/290 F; 29/825; 339/275 E, 275 R

[56] References Cited

U.S. PATENT DOCUMENTS

| | | | |
|---|---|---|---|
| 2,258,435 | 10/1941 | Adolph et al. | 204/289 |
| 3,511,766 | 5/1970 | Kisner et al. | 204/286 X |
| 3,602,655 | 8/1971 | Scofield et al. | 29/825 X |
| 4,022,679 | 5/1977 | Koziol et al. | 204/286 |
| 4,251,337 | 2/1981 | Orr et al. | 204/286 X |
| 4,364,811 | 12/1982 | Fabian et al. | 204/288 X |
| 4,379,742 | 4/1983 | Rathjen et al. | 204/288 X |
| 4,394,532 | 7/1983 | Aguayo | 29/825 X |
| 4,534,846 | 8/1985 | Woodard, Jr. et al. | 204/286 X |

*Primary Examiner*—Donald R. Valentine
*Attorney, Agent, or Firm*—Lyon & Lyon

[57] ABSTRACT

An electrode for electrolytic extraction of metals or metal oxides comprises a horizontally arranged current feed which has a copper rail as current feeding component. From this rail at least one current distributor branches, which consists of a sleeve of valve metal and a core arranged therein and consisting of metal which is a good electrical conductor which is in good electrical connection with the sleeve and in which preferably a contact structure is embedded. To the sleeve of the current distributor an active part of the electrode is mechanically and electrically connected.

The rail of the current feed of copper is provided in the region of the connection position of a current distributor with a connection element of valve metal which is connected to the copper rail via a separate copper element by explosion welding.

13 Claims, 10 Drawing Figures

ELECTRODE FOR ELECTROLYTIC EXTRACTION OF METALS OR METAL OXIDES

The invention relates to an electrode, in particular an anode of coated valve metal for electrolytic extraction of metals or metal oxides, consisting of a horizontally arranged current feed which is formed by a rail of copper or comprises such a rail, of at least one current distributor, which branches from this rail, and which is constructed of a sleeve of valve metal and a core arranged therein of metal which is a good electrical conductor and is in electrical connection with the sleeve and in which preferably a contact structure is embedded which consists of valve metal and is connected to the inner surface of the sleeve by a plurality of weld points, and of an active part which is connected mechanically and electrically to the sleeve of the current distributor.

Coated metal anodes of this type are intended to replace the anodes of lead, lead alloys or graphite formerly used in the field of electrolytic extraction of metals, in particular non-ferrous metals, from acid solutions which contain the metal to be extracted. The working surface or the active part of these coated metal anodes consists of a core carrier of valve metal such as for example titanium, zirconium, niobium or tantalum, on which is applied a coating of an anodically effective material, for example of metals from the platinum group or the platinum metal oxides.

The main advantage of the metal anodes consists in the saving of electrical energy as compared with the usual lead or graphite anodes. This energy economy results from the larger outer surface which can be achieved with coated metal anodes, the high activity of the coating and the shape stability. It enables a considerable reduction of the anode voltage. The coated metal anodes result in a further operational economy in that cleaning and neutralization of the electrolyte is simplified since the anode coating is not destroyed by $Cl^-$, $NO_3^-$ or free $H_2SO_4$. An additional cost saving is achieved in that, with the use of coated metal anodes, the electrolyte need not be alloyed with expensive components such as cobalt compounds or strontium carbonate, such as is necessary in the use of lead anodes. Furthermore, contamination of the electrolyte and the extracted metal with lead, which cannot be avoided with lead anodes, is prevented. Finally, the coated metal anodes permit increase of the current density and thus of the productivity.

In the development of these coated metal anodes, widely differing routes have been followed.

In a known metal anode of the type under discussion (DE-OS No. 24 04 167) the important construction criterion was seen in that the anode surface lying opposite the cathode should be 1.5 to 20 times smaller than the cathode outer surface and the anode would accordingly be operated with a current density which is 1.5 to 20 times larger than the cathode current density. As a result, in an economical manner a relatively clean metal extraction of the desired crystalline structure and purity is alleged to be obtained on the cathodes. It is apparently maintained that the economy consists in that as a result of the reduced surface of the anode opposite the cathode the material consumption for the production of the anode is reduced and thus expensive valve metal substance is saved. The cost reduction in the manufacture of this anode is however achieved at the expense of not inconsiderable disadvantages. One of the disadvantages consists in that the anodic component of the cell voltage is high because the anode operates with a high current density. This necessarily results in the substantial disadvantage of high energy requirements for the cells equipped with such anodes. The large current density and the reduced conductive cross-section of the known anode, as a result of the reduced effective surface and thus of the smaller material volume, necessarily results in a larger internal ohmic voltage drop with the consequence of further increase of the necessary electrical energy. In order to eliminate the disadvantage of the large internal ohmic voltage drop, the profile bars arranged in one plane parallel to one another, which form the effective surfaces, consist of a sleeve of titanium which is provided with a copper core. The current feed and distribution rails have a comparable construction. These are guided in a complicated manner in order to shorten substantially the current path in the small effective surface of the anode. The complicated construction of the profile bars forming the effective surface and the necessarily long current feed and distribution rails increase the expense of the known construction considerably.

In a further known coated metal anode (DE-OS No. 30 05 795) a completely different route has been taken for preventing the principal disadvantages of the above described coated metal anode, which consists in that the effective surface of this anode is constructed to be very large in such manner that the mutually spaced and parallel bars arranged in one plane to form the effective surface satisfy the relationship $6 \geqq F_A/F_P \geqq 2$, $F_A$ signifying the total outer surface of the bars and $F_P$ signifying the surface assumed by the overall arrangement of the bars. This anode construction, preferably manufactured from pure titanium, has no current feed and distributor besides the main current feed bar of copper. The current transport in the vertical direction is undertaken solely by the bars of valve metal. All in all, this anode has proved very effective in many electrolytic metal extraction methods owing to the large construction of the effective surface.

In order to adapt the titanium anodes to increasing kilowatt hour prices, i.e. to reduced internal ohmic voltage drop, the introduction of larger conductive cross-sections for the current-carrying components of this expensive metal is required. When constructing the active surface of two titanium bars arranged parallel to one another in one plane, these must be constructed with appropriately large cross-section in order to keep pace with the internal ohmic voltage drop occurring in thick massive lead anodes, which reduces again the technical and economic advantages of the valve metal anodes.

With the known current feed and distribution rails, consisting of a core of copper and a sleeve of titanium surrounding this copper core, it is attempted to achieve a "metallurgical joint" between the metal of the core and the metal of the sleeve. The reduction of the internal voltage drop, which is supposed to be achieved by constructing the core of a metal having good electrical conductivity, is only however actually achieved if the current transfer to the coated active part is ensured by a large area fault-free metallurgical joint between the material of the sleeve and the material of the core. This requirement is however achieved to a limited extent only with a very expensive manufacture. In spite of this, these current feeds for anodes have proved effective in chlor-alkali-electrolysis according to the diaphragm process. The temperature sensitivity of the metallurgical joint between copper and titanium presupposes however that in the case of recoating of these anodes for diaphragm cells the titanium clad copper bar is separated from the active part to be coated.

The electrode set forth in the preamble of claim 1 was developed to solve these problems (DE-OS No. 32 09 138). According to this, attention was first of all directed to the construction of the current feed and of the current distributor. The main constructional idea in this electrode consists in that the current feed and the current distributor are constructed from a valve metal sleeve assembled from profile members and having a core therein of metal which is a good electrical conductor, the core being in good electrical connection with the sleeve and moreover a contact structure being embedded in this core which consists of valve metal and is connected via a plurality of weld points to the inner surface of the sleeve. Such a contact structure is three-dimensional and has a plurality of surfaces oriented in a plurality of directions and is surrounded by the core metal from a plurality of directions. According to a preferred embodiment, the contact structure consists of one or more strips of expanded metal, wire netting, apertured sheet or the like. Each strip advantageously lies in the current feed or current distributor in the direction of current flow. By means of the described features, in the known electrode a good electrical connection between the core metal and the sleeve metal is achieved with the consequence of small voltage drops even with high current loads. The internal contact achieved between the contact structure and the core metal remains effective for a long service life even when subjected to high temperature differences. Moreover, the contact structure improves the mechanical strength of the correspondingly constructed current feeding component and thus of the electrode as a whole. The described electrode can moreover be manufactured cheaply and economically because the difficulties which occur in the previously known arrangements in respect of the metallurgical joint between the core metal and the sleeve metal or in respect of the provision of a suitable intermediate layer, for example of a substance which is liquid at the operational temperatures, are avoided. In the manufacture of the known electrode, the core metal can be simply poured into the inner space of the sleeve in the fluid state. As a result of the corresponding formation of the contact structure, the core metal flows around inside the contact structure and forms a shrink fit on this with the creation of residual stresses. As a result, the desired good contact between the core metal and the contact structure is achieved. This is in addition welded in an electrically conductive manner to the inner surface of the sleeve. Thus, everything considered, the known electrode is distinguished by a very small internal voltage drop over a long service life, by cost-favourable and economic manufacture possibilities, by high operational safety and by its relatively flat construction.

Finally, in a known metal electrode (U.S. Pat. No. 4,251,337) the current feed of copper is connected to the electrode plate of titanium via a strip of titanium. For each connection position between current feed and the respective electrode plate the strip of titanium is to be connected to the current feed rail of copper by means of explosion welding. As a result, only very short connection lengths between the current feed rail of copper and the respective strip of titanium are achieved with the consequence that the explosion weld is very cost intensive.

As against the described state of the art, it is an object of the invention to provide for the electrodes of the described type a connection construction between the current feed and the current distributor or distributors which feed the current to the active part of the electrode in which explosion welding can be employed in a favourable manner.

This object is solved in an electrode of the above-described type in that the rail of copper in the region of the connection position of a current distributor is connected to a copper element to which is welded by explosion welding a connection element of valve metal, to which the current distributor is connected.

The solution according to the invention is distinguished fundamentally in that in contrast to the connection construction according to U.S. Pat. No. 4,251,337 a "separate" copper element is incorporated into the connection. Thereby it is possible that in an initial process relatively long copper and also relatively long valve metal strips are connected together and from this thus manufactured connected plate then the connection elements, that is to say the respective connection element of copper and the respective connection element of valve metal, already connected together by explosion welding, can be cut. The so-constructed connection elements can then easily be connected to the copper current feed rails via the copper element. As a result of the described long connection length of copper and valve metal strips in the initial process, the explosion welds prove to be both simple in manufacture and also economic.

As a result of the connection construction according to the invention, furthermore a very intimate connection, achieved by inter atomic bonds, is achieved between the copper rail of the current feed and the connection element on which then the actual current distributor is arranged, which connection first of all ensures a voltage drop which is as small as possible and furthermore also results in a mechanically stiff connection. In many experiments it has proved that by use of a purely mechanical connection, such as for example by screws, clamps, and the like an insufficiently effective current transfer between the components is achieved. Moreover, naturally also the mechanical connection means are unfavourable in respect of costs and for the most part also insufficiently mechanically rigid since they may well become loosened under application of load.

The connection construction according to the invention is moreover very sturdy mechanically which is effective correspondingly on the whole electrode so that this satisfies the actual operational requirements in metal electrodes for the electrolytic recovery of metals or metal oxides. Such metal electrodes must as is known be withdrawn from the cell for cleaning or stripping and thereafter be inserted into this again, considerable mechanical effects being exerted on the electrodes during this working and moving process.

Although the form and dimensions of the connection elements of valve metal can be selected arbitrarily, in the final analysis the most widely varying constructions of current distributor of the above-described type can be connected to the connection elements, thus current distributor constructions which are formed from a sleeve of valve metal, a core poured therein and consisting of electrically conductive metal and a contact structure embedded therein. The forms and dimensions of these current distributors vary according to the construction of the active part and the current to be transported. The connection construction according to the invention allows for this reason a multiplicity of constructions of the electrodes equipped therewith.

According to a further development of the anode construction according to the invention, the connection element is formed by a plate of valve metal whose connection dimensions correspond substantially to those of the relevant current distributor. The width of the connection plate is in this connection expediently not larger than the width of the copper rail of the current feed so that the plate does not extend beyond the rail. On the other hand, the connection dimensions, i.e. width and length, are substantially adapted to those of the associated current distributor. All in all, the dimensions of the connection plate are thus adapted to the cross-sectional dimensions of the current distributor. These in turn depend upon the currents to be conducted through the current distributor with the predetermined small voltage drop and upon the type of active part which is connected to the current distributor.

According to a further exemplary embodiment of the electrode according to the invention, the connection element is arranged on a through-going surface of the rail. This measure results in a simple construction of the rail of the current feed, since this may basically be one of the usual constructions.

A series of methods of integration are now available for the connection elements with associated copper element with the current feed rail of copper. One possibility consists in that the connection element with the associated copper element forms a section of the rail. In this solution, thus the rail is formed of sections, a few of the sections being formed by the respective connection element with the associated copper element, whilst the sections of the rail connecting the connection construction consist exclusively of copper. A further possibility may be seen in that the connection element with the associated copper element is inserted into a corresponding opening in the rail. The copper rail is thus provided here with one or more openings according to the number of current distributors, so that the connection element with the relevant copper element is inserted into the relevant opening. In this connection, the connection element may be flush with the corresponding surface of the copper rail. The connection element and to some extent the associated copper element can however also be arranged to extend from the corresponding surface of the copper rail.

It is expedient that the copper element is connected to the rail by argon arc welding. Here also a metallurgical connection is achieved with the advantages of favourable current transfer and in addition a very rigid mechanical connection.

A particularly favourable possibility of connection of the current distributor to the associated connection element of the current feed is seen in that the current distributor is provided on its connection end with a connection plate of valve metal and the current distributor is connected via this connection plate to the connection element. In various embodiments of the current feed suggested in DE-OS No. 32 09 138 such connection plates are already provided. Via these, the current distributor can then be connected to the connection elements of the current conductor. This results in a simple construction in combination with the known current distributors which have already proved themselves in operation.

For connection of the connection plate of the current distributor to the connection element of the current feed, it is possible to employ a built-up weld joint between the connection element and the connection plate of the current distributor. Also here is once again a metallurgical joint formed between the two parts in order to achieve the already explained advantages.

In order to protect the copper rails of the current distributor and the connection constructions between the current feed and the current distributor from corrosion and possibly mechanical damage, various possibilities have been developed.

One of the solutions consists in that the rail of the current feed is surrounded by a surrounding cast sleeve of for example lead and this sleeve on the connection position of a current distributor extends at least up to its sleeve.

A second principal possibility is seen in that the rail is guided in a sleeve which consists of profile members of valve metal. This construction allows a particularly wide range of constructions of the current feed. The current feed can thus be constructed according to the current distributors. Thus, also the sleeve of the current feed can be filled up with core metal in which a contact structure can be embedded. Furthermore, the sleeve of the current distributor may be connected to the sleeve of the current feed in a gas and liquid tight manner.

The expedient materials for the active part of the electrode according to the invention have already been mentioned. It consists accordingly of a supporting core of a valve metal, such as for example titanium, zirconium, niobium, or tantalum on which a coating of an anodically effective material, for example of metals of the platinum group or of metal oxides, is applied. The form of the active part can be selected arbitrarily. It can be formed of rods, sheets or the like. It is particularly preferred however to use corrugated expanded metal because this configuration results in a very large active outer surface economical in use of valve metal and in addition is sufficiently mechanically stable, in particular if protective measures are undertaken for the free edges of the selected expanded profile member. Such protective measures can consist in separately applied material strips on the free edges of the active part of expanded metal.

The profile members for the sleeves of the electrode according to the invention, both with reference to the current distributor and also with reference to the corresponding construction of the current feed, have expediently a wall thickness between 0.5 mm and a few millimeters. They consist likewise of one of the already-mentioned valve metals.

As metal for the manufacture of the core of the current distributor used in the electrode according to the invention, metals having a melting point which lies at least 500° C. lower than the metal of the sleeve of the current feeding components are suitable. The core metal should furthermore have a substantially higher electrical conductivity than the valve metal of the sleeve, for example titanium. Having regard to these requirements, the core metal may be manufactured from zinc, aluminium, magnesium, tin, antimony, lead, calcium, copper or silver and corresponding alloys. Of course, selection of the metal for the core must take account of the special requirements of the respective metal extraction process. For the electrolytic extraction of zinc, zinc may be employed as core metal. The same applied for the extraction of copper, although here also aluminium, magnesium, or lead and corresponding alloys may be employed.

The solution according to the invention is suitable for the construction both of smaller electrode types with electrode surfaces of about 1.0 to about 1.2 $m^2$ and also for so-called jumbo electrodes having an electrode area of about 2.6 $m^2$ to about 3.2 $m^2$.

The construction and advantages of exemplary embodiments of the electrodes according to the invention will be explained in the following with reference to the drawings, in which.

Figure 1:
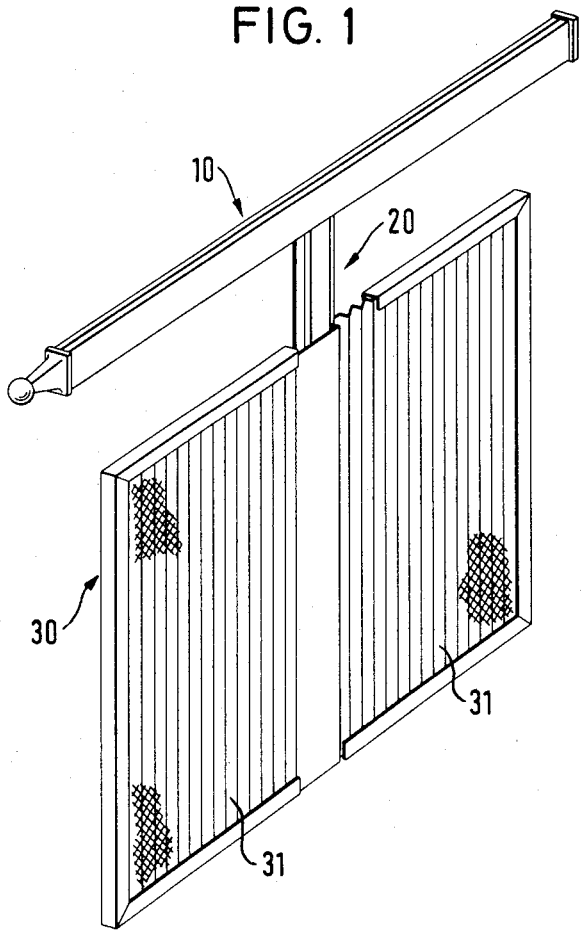
FIG. 1 is a perspective overall view of a small electrode constructed according to the invention.
Figure 2:
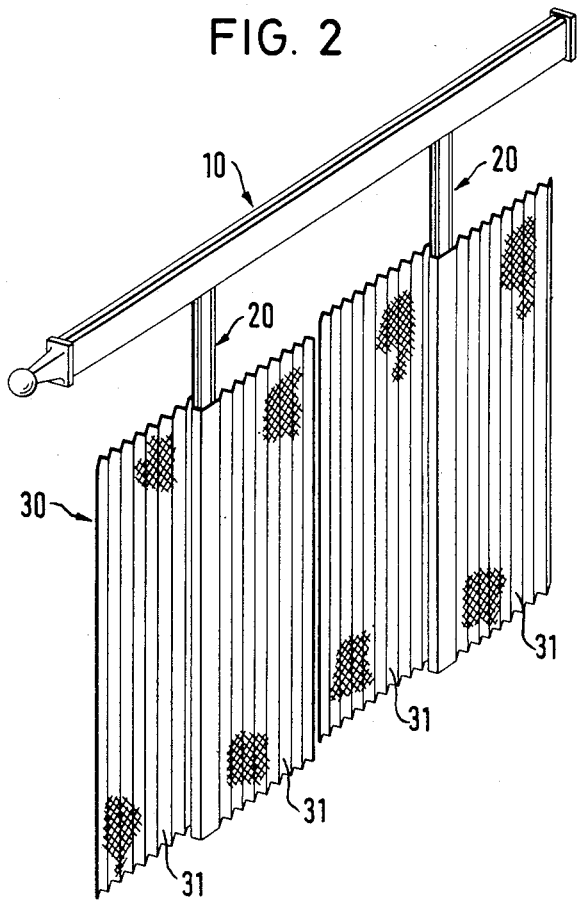
FIG. 2 shows a perspective overall view of a large electrode constructed according to the invention.

FIGS. 1 and 2 show the principal construction of two versions of a coated metal anode according to the invention. Accordingly, a current feed designated with 10, a current distributor with 20, and an active part connected to the current distributor, i.e. the active effective surface of the electrode, is designated with 30.

FIG. 1 shows the small and most usual version of a metal anode having an anode surface of about 1.0 to 1.2 $m^2$. In this small electrode only one current distributor 20 connected to the current feed 10 is provided on whose two sides parallel to the current feed respective plate-like elements 31 are arranged which together form the active part 30.

In FIG. 2 in contrast is illustrated a so-called jumbo anode having an anode surface of about 2.6 to 3.2 $m^2$. This electrode comprises two current distributors 20 connected to the current feed 10. On each of these current distributors 20 are arranged on respective sides plate-like elements 31, so that overall four of these plate-like elements 31 form the active part 30 of the electrode. The lateral edges of the two inner plate-like elements 31 can lie at a distance from one another and can be connected together by not illustrated bridging elements. The two inner plate-like elements 31 can however also be formed by one integral element.

Figure 4:
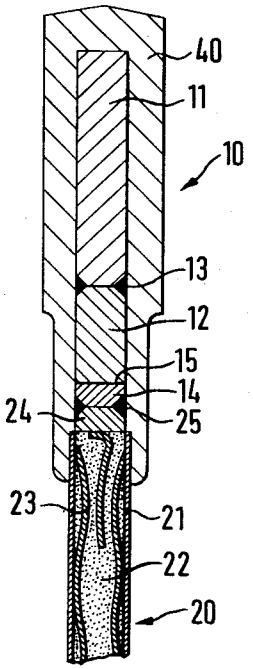
FIG. 4 shows a longitudinal section through the arrangement according to FIG. 3.
Figure 3:
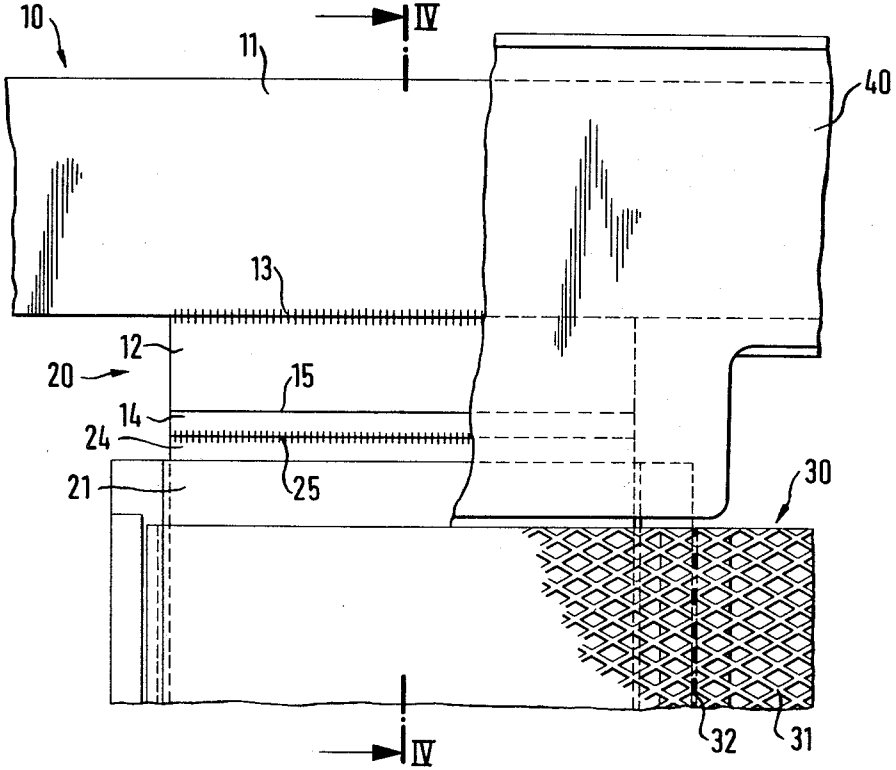
FIG. 3 is an enlarged view of the connection construction between current feed and current distributor of the electrode according to the invention.

FIGS. 3 and 4 show the connection construction between the current feed 10 and the respective current distributor 20 and its construction as well as the form of the active part 30.

According to this, the current feed designated as a whole with 10 consists of a horizontally extending rail 11 which is of a material which is a good electrical conductor, preferably copper. On the connection position of one current distributor 20 is arranged on the underside of the rail 11 an element 12, likewise of copper. This copper element 12 consists of a plate having a breadth corresponding to the breadth of the rail 11 and a length which is slightly smaller than the corresponding breadth of the current distributor 20. The copper element 12 is connected to the rail 11 by a weld seam 13 which expediently is produced by argon arc welding. As a result, an intimate metallurgical joint is achieved between the rail 11 and the copper element 12 which ensures a very good current transfer between these two components.

On the lower free surface of the copper element 12 is arranged a connection element 14. This connection element 14 consists of a valve metal, expediently titanium, and likewise has the form of a plate. The width of the plate corresponds to the width of the copper element 12 and thus to the width of the rail 11. Also the lengths (in the direction of the extension of the rail 11) of the copper element 12 and connection element 14 are equal. The copper element 12 and the connection element 14 are intimately connected together by inter atomic bonds as a result of explosion welding 15. Also here an excellent current transfer is thus achieved combined with great mechanical strength.

The current distributor 20 comprises a sleeve 21 of rectangular cross-section which expediently is assembled of suitable profile members of valve metal, preferably titanium. A core metal 22 of material which is a good electrical conductor is poured into the sleeve. In the core metal, a contact structure 23 is embedded which expediently consists of expanded metal strips and is connected to the inner surface of the sleeve 21 of the current distributor 20 via a plurality of weld points. On the end of the current distributor facing towards the current feed 11, the sleeve 21 is closed by a connection plate 24 of valve metal which expediently is welded to the sleeve 21 and on the other side is connected to the contact structure 23 likewise by welding. Thus, a good current transfer between the connection plate 24 and the core metal 22 and the contact structure 23 of the current distributor 20 is ensured. On the other hand, this connection plate 24 is metallurgically connected to the connection element via a weld joint 25 which expediently is produced by build-up of argon arc weld so that also here good current transfer is achieved.

The current distributor 20 carries as active part, as has already been explained, plate-like elements 31. As appears clearly from FIGS. 3 and 4, each plate-like element 31 is represented by a corrugated expanded metal. The electrical and mechanical connection between each plate-like element 31 and the sleeve 21 of the current distributor 20 takes place by a correspondingly guided weld seam 32.

The current feed rail 11 is surrounded as a whole by a sleeve 40 which preferably consists of lead and protects the rail 11 within the cell from corrosion. In the region of the connection position of one current distributor this sleeve 21 is stripped down to the sleeve 40 of the current distributor 20 so that the sleeve 40 partially overlaps the sleeve 21. In this manner, all connection components including the weld seams are likewise protected from corrosion and possibly from mechanical damage.

Figure 5:
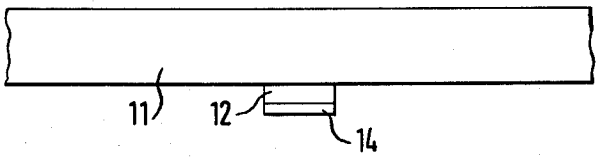
FIG. 5 shows a main possibility of the arrangement of the connection elements on the copper rail.

FIG. 5 represents the configuration of connection element 14, copper element 12 and rail 11, such as is illustrated in FIGS. 3 and 4. Accordingly, the connection element 14 is arranged over the copper element 12 on the lower through-going surface of the rail 11.

Figure 6:
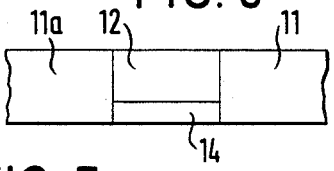
FIG. 6 shows a further possibility of integrating the connection elements into the current feed rail.

FIG. 6 relates to a further possibility of constructing the rail 11 including a connection element 14. Accordingly, the connection element 14 and the associated copper element 12 form a section of the rail 11 whilst the other section 11*a* consists exclusively of copper.

Figure 7:
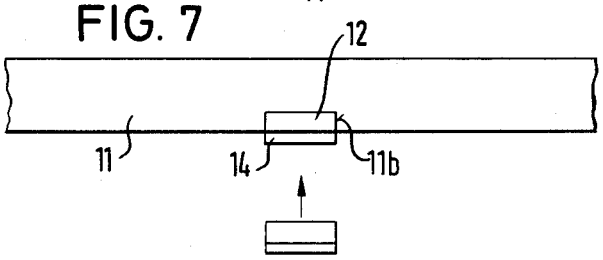
FIG. 7 shows a further possibility of the arrangement of the connection elements on the current feed rail.

According to FIG. 7, which relates to a further possibility, an opening 11*b* is punched out, milled out, or cut out from the rail 11, into which opening the connection element 14 can be inserted by means of the copper element 12.

Figure 9:
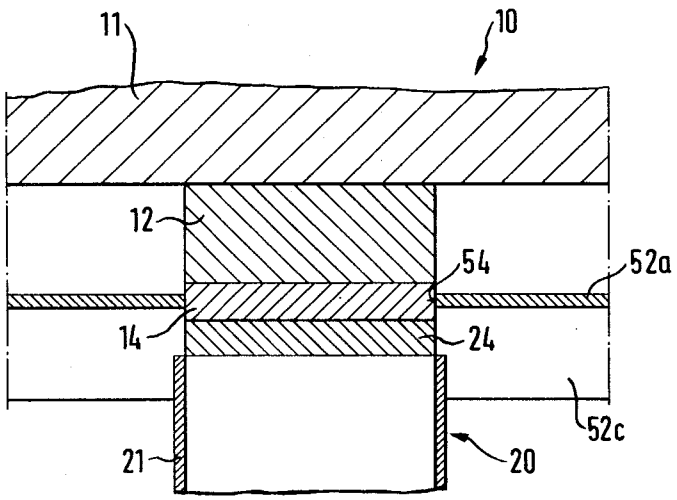
FIG. 9 shows a longitudinal section through the arrangement according to FIG. 8.
Figure 8:
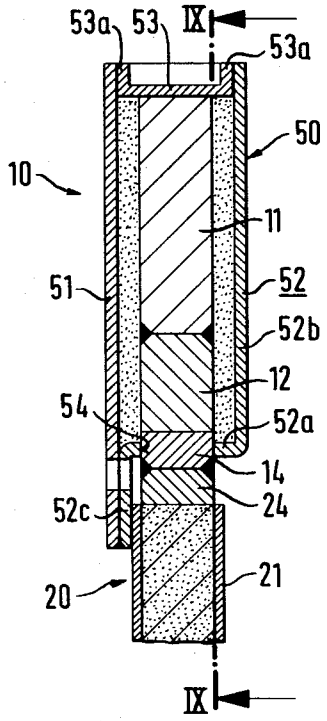
FIG. 8 shows a cross-section through a further embodiment of connection construction between current feed and current distributor of an electrode according to the invention.

FIGS. 8 and 9 relate to another construction of the current feed 10. Accordingly, the copper rail 11 runs inside a sleeve designated as a whole with 50 and consisting of valve metal, preferably titanium. This sleeve 50 is assembled from three profile members. First of all, a flat profile member 51 is provided. The further profile member 52 has an S-form, and is formed from a crosspiece 52 of which on the one hand a longer limb 52*b* and on the other hand a shorter limb 52*c* are bent in opposite senses. This profile member 52 lies with its short limb 52*c* in the region of the lower edge of the flat profile member 51. In this region, the two profile members are expediently connected together by a roll weld seam. The sleeve 50 is closed by a U-shaped profile member 53 which lies with its two limbs 53*a* within the upper edges of the profile members 51 and 52 and is connected in this region with these two profile members expediently by welding. This so-constructed sleeve 50 surrounds also the copper element 12 which is arranged in this exemplary embodiment according to FIG. 5 on the rail 11. The connection element 14 passes through an opening 54 in the crosspiece 52*a* of the profile member 52. On the lower side of the connection element 14 is secured the current distributor 20 via its connection plate 24 in the manner already described.

In a manner which is not illustrated, between the rail 11 and the sleeve 50 of the current feed 10 a core metal can be poured in in which also a contact structure can be embedded.

The connection of the components 11, 12, 14 and 24 can be achieved in the already-described manner.

Finally, the sleeve 21 of the current distributor 20 can be mechanically and electrically conductively connected by welding to the short limb 52*c* of the profile member 52 of the sleeve 50 of the current feed.

Figure 10:
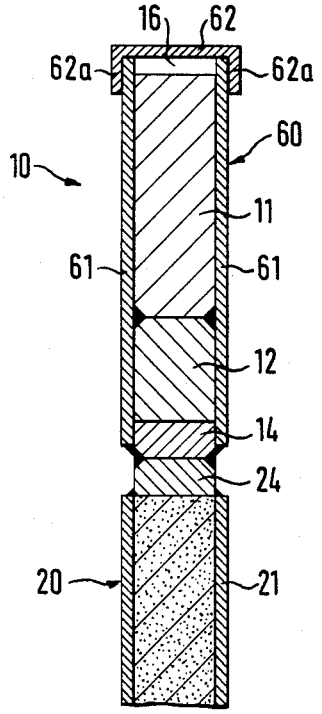
FIG. 10 shows a cross-section through a further exemplary embodiment of the connection construction between the current feed and current distributor of the electrode according to the invention.

FIG. 10 shows a slightly simplified construction of a sleeve 60 of valve metal for the rail 11 of the current feed 10. Accordingly, the two side surfaces of the rail 11 are each covered by a flat profile member 61 which is welded to the connection piece 14. These two profile members are closed above by a U-shaped profile member 62 which engages around the upper edges of the profile member 61 with its two limbs 62*a* and is welded in this region to the two profile members 61.

The remaining features of the connection construction are comparable with those of the already described arrangements.

In the case of a sleeve 50 or 60 of valve metal for the rail 11 of the current feed 10, it has proved valuable to retain between the upper side of the rail 11 and the U-shaped connection profile member 53 or 62 a slot 16 so that the weld seam between the U-shaped profile member 53 or 62 and the further profile members 50, 52 or 61 do not lie directly in the region of the copper rail 11 so that during welding no negative thermal influences are exerted on the copper rail 11.

We claim:

1. An electrode for the electrolytic extraction of metals or metal compounds comprising:

a horizontal current feed having an electrically conductive rail;

at least one current distributor branching from said rail and comprising a sleeve of valve metal and a conductive metal core in electrical connection with said sleeve; an active part which is mechanically and electrically connected to said sleeve; and a copper element connected to said rail and a connection element of valve metal welded by means of explosion welding to said copper element, said connection element of valve metal further electrically and mechanically connected to said current distributor.

2. An electrode according to claim 1 wherein said connection element is formed from a plate whose connection dimensions correspond substantially to those of the associated current distributor.

3. An electrode according to claim 1 wherein said connection element is butt-jointed on a surface of the rail.

4. An electrode according to claim 1 wherein said connection element together with the associated copper element forms a section of the rail.

5. An electrode according to claim 1 wherein said connection element with said associated copper element is inserted in a corresponding opening in the rail.

6. An electrode according to claim 1 wherein the copper element is connected to the rail by argon arc welding.

7. An electrode according to claim 1 wherein the current distributor is provided on its connection end with a connection plate of valve metal and the current distributor is connected via said connection plate to the connection element of valve metal.

8. An electrode according to claim 7 wherein a built-up weld joint is provided between the connection element and the connection plate of the current distributor.

9. An electrode according to claim 1 wherein the rail of the current feed is surrounded by a cast sleeve which at the connection position of a current distributor extends at least to said distributor.

10. An electrode according to claim 1 wherein the rail is guided in a sleeve which consists of valve metal.

11. An electrode according to claim 10 wherein the sleeve of the current distributor is connected in a gas and liquid tight manner to the sleeve of the current feed.

12. An electrode according to claim 10 wherein the sleeve of the current feed has core metal cast therein.

13. An electrode according to claim 12 wherein a contact structure is embedded in the core metal cast into the current feed.

* * * * *